US005507218A

United States Patent [19]

Lipinski

[11] Patent Number: 5,507,218

[45] Date of Patent: Apr. 16, 1996

[54] LINEAR-DRIVE CYLINDER

[75] Inventor: Reinhard Lipinski, Plochingen, Germany

[73] Assignee: Invest Tech AG, Rotkreuz, Switzerland

[21] Appl. No.: 371,549

[22] Filed: Jan. 11, 1995

[30] Foreign Application Priority Data

Jan. 11, 1994 [DE] Germany ..... 44 00 483.4

[51] Int. Cl.[6] ..... F01B 29/00

[52] U.S. Cl. ..... 92/88; 92/85 B; 92/143; 92/164

[58] Field of Search ..... 92/128, 164, 171.1, 92/88, 165 PR, 85 B, 143, 118

[56] References Cited

U.S. PATENT DOCUMENTS

| | | | |
|---|---|---|---|
| 2,518,787 | 8/1950 | Huhtala | 92/164 |
| 2,903,308 | 9/1959 | Barnhart | 92/118 |
| 2,979,369 | 4/1961 | Flick et al. | 92/118 |
| 3,474,710 | 10/1969 | Stryker | 92/128 |
| 4,211,150 | 7/1980 | Framberg | 92/164 |
| 4,572,057 | 2/1986 | Wewerka | 92/165 PR |
| 4,825,746 | 5/1989 | Herner | 92/88 |

FOREIGN PATENT DOCUMENTS

| | | | |
|---|---|---|---|
| 0060412 | 9/1982 | European Pat. Off. . | |
| 1954888 | 5/1971 | Germany . | |
| 7734682 | 3/1978 | Germany . | |
| 2846027 | 5/1979 | Germany . | |
| 82 14 767.1 | 6/1983 | Germany . | |
| 3844511 | 1/1990 | Germany . | |
| 4024716 | 2/1992 | Germany . | |
| 562073 | 6/1944 | United Kingdom | 92/164 |
| 1329629 | 12/1970 | United Kingdom . | |
| WO90/14520 | 11/1990 | WIPO . | |

*Primary Examiner*—Thomas E. Denion
*Attorney, Agent, or Firm*—Foley & Lardner

[57] ABSTRACT

A linear-drive cylinder actuated by a pull means or by a pressure medium has a cylinder tube, in which a piston is guided axially displaceably. The movement of the piston is guided outward via force-transmission means. The cylinder tube is closed on the end face by means of a closing plug. Both the cylinder tube and the closing plug each have a transverse bore. A fastening means, such as, for example, a holding tube or a bolt, passes through the mutually aligned transverse bores, so that the closing plug is secured axially in the cylinder tube.

29 Claims, 7 Drawing Sheets

LINEAR-DRIVE CYLINDER

BACKGROUND OF THE INVENTION

The invention relates to a linear-drive cylinder having a cylinder tube in which a piston is mounted displaceably in the longitudinal direction, with a force-transmission means which forms a driven member and which is connected to the piston and is guided out of the cylinder tube.

Linear drives known in practice are so-called linear modules, in which a piston is moved via a pressure medium or via pull means in an elongate, essentially closed or laterally slotted guide tube, said piston actuating machine elements to be driven, by means of suitable force-transmission means, such as, for example, a piston rod or a driver passing through the lateral slot of the guide tube. In all these linear drives, the guide tube of greater or lesser length is closed on the end face by means of a cover or closing piece. When the linear drive is actuated by pressure medium, this cover serves for sealing off the chamber otherwise limited by the piston and the guide tube. When the linear drive is actuated by a pull means, a gear and a motor, such as, for example, a stepping motor, are arranged on the closing piece. To fasten the respective covers on the guide tube, it is usually necessary to carry out relatively complicated machining operations on the guide cylinder which is otherwise simply cut to length from prepared semi-finished products.

A linear drive actuated by pressure medium is known from GB 1,329,629. This has a longitudinally slotted guide tube which is sealed off via a flexible band and in which is mounted in a sealed-off and displaceable manner a piston which passes with a flat driver through the lateral slot of the guide tube. The guide tube is closed on the end faces by means of covers resembling cylinder heads. For this purpose, the guide tube is provided with an external thread. The respective covers have corresponding internal threads which engage with the external thread of the guide tube.

In this linear drive, after the guide tube has been cut to length it is necessary to apply an external thread to the ends of the guide tube.

A pressure-medium cylinder having a likewise longitudinally slotted cylinder closed on the end faces is known from EP 0,113,790 A1. This has a cylinder tube, in which is mounted in a longitudinally displaceable and sealed-off manner a piston which passes through the lateral slot with a web-like part which, in conjunction with a force-transmission element, serves as a driven member. The cylinder is closed on the end face by means of a cover which has a cylindrical portion projecting somewhat into the interior of the cylinder tube. Adjacently to the cylindrical portion, the diameter of the cover increases, so that the latter has an annular shoulder. The annular shoulder bears on the end face of the cylinder tube. To fix the cover to the pressure-medium cylinder, threaded bores, into which fastening screws passing through the cover are screwed, are made in the end face of the cylinder tube.

During the production of the cylinder tube, it is necessary, after a correspondingly prepared semi-finished product has been cut to length, to make a plurality of threaded bores in the cylinder tube in a manner distributed over the end face. This presupposes a minimum wall thickness which cannot fall below a set value.

SUMMARY OF THE INVENTION

An object of the invention is to provide a linear-drive cylinder, the design of which allows a high degree of freedom in dimensioning and which can be produced cost-effectively.

This object is achieved by means of a linear-drive cylinder including a cylinder tube having a longitudinal direction and a bore transverse to the longitudinal direction; a piston mounted in the cylinder tube and displaceable in the longitudinal direction; a closure which closes an end of the cylinder tube and which projects with at least one portion into the cylinder tube; and fastening means for fastening the closure to the cylinder tube; wherein the closure includes a closing plug which is introduced into the cylinder tube, the closing plug including at least one transverse bore coaxial with the bore in the cylinder tube; and wherein the fastening means extends transversely to the longitudinal direction of the cylinder tube into the transverse bore of the closing plug and the bore of the cylinder tube.

Preferably, the transverse bore of the closing plug is a through-bore.

In a preferred embodiment, the fastening means includes a screw seated in the bore and the transverse bore.

In another preferred embodiment, the fastening means includes a bolt which passes through the cylinder tube and the closing plug and a nut which secures the bolt.

Advantageously, the fastening means includes a bolt, and the bore of the cylinder tube includes an internal thread wherein the bolt extends into the closing plug and is in engagement with the internal thread and the bore of the cylinder tube.

In another embodiment, the closing plug includes at least one channel connecting the transverse bore of the closing plug to an interior enclosed by the cylinder tube. Preferably, the fastening means includes a through-bore which is connected to the channel. The channel may include a second bore lying coaxial relative to the cylinder tube.

Further objects, features and advantages of the present invention will become apparent from the following detailed description taken in conjunction with the accompanying drawing.

BRIEF DESCRIPTION OF THE DRAWING

The drawing is hereby expressly made a part of the specification. Exemplary embodiments of the subject of the invention are illustrated in the drawing, in which.

DETAILED DESCRIPTION OF THE PREFERRED EMBODIMENTS

Figure 1:
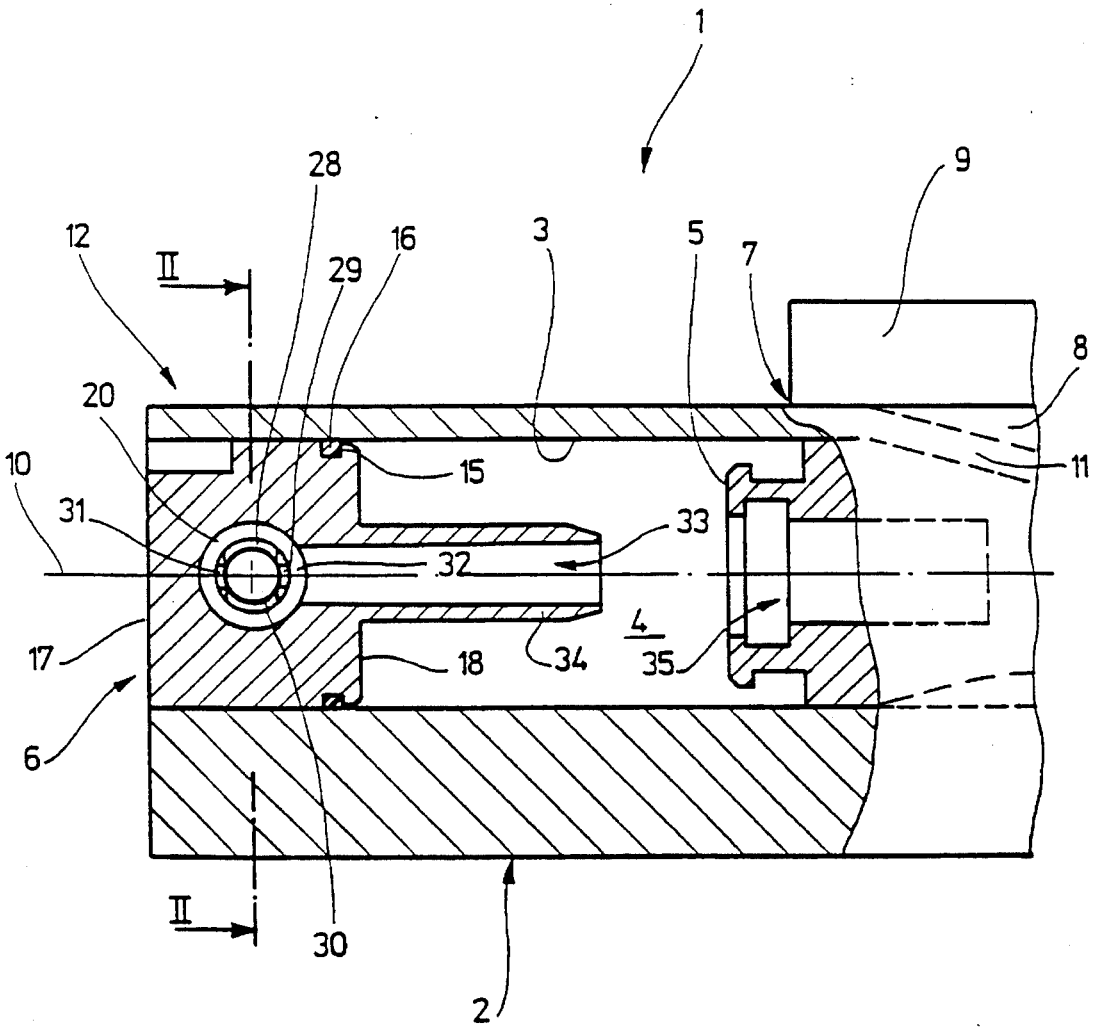
FIG. 1 shows a linear-drive cylinder in a cut-out and partially cut away representation.

Because its function is to guide the slidably mounted piston, the cylinder bore made in the cylinder tube has a smooth wall ex-factory. This smooth wall offers a specific bearing face for the closure designed as a closing plug, without the need for a machining of the cut face or end face obtained when the cylinder tube is cut to length. The at least one transverse bore provided for fastening the closing plug in the wall of the cylinder tube can be made in the cylinder tube easily and without much outlay. The thickness of the wall plays scarcely any part in this. Even if the wall is to be relatively thin, specifically so thin that a relatively thick stud bolt or a relatively large threaded bore can no longer be drilled in the wall in the longitudinal direction without further action, the transverse bore offers a firm hold to the fastening means passing through the latter. The fastening means, which can, for example, be a bolt or a holding tube, is inserted transversely in the closing plug and the transverse bore of the cylinder tube. The cylinder tube can have two transverse bores which are located diametrically opposite one another and which are aligned with the transverse bore of the plug. In this case, a single-fastening means, for example a tube or bolt, can be inserted through the transverse bores and fixed therein, other embodiments also being possible. A feature common to all of them is that the closing-off of the cylinder tube is achieved by means of few parts, which are cost-effective to produce and simple to mount.

In principle, it is sufficient if the closing plug has one or more blind bores which coincide with corresponding transverse bores of the cylinder tube. Fastening means, which both pass through the transverse bores of the cylinder walls and project into the blind bores, fix the closing plug in the axial direction. It is advantageous, however, if the transverse bore of the closing plug is a through-bore. This makes it possible, in particular, to use a single fastening means which passes completely through the cylinder tube and the closing plug.

The transverse bore of the closing plug can be made smooth-walled. If the transverse bore is at the same time a through-bore, for example a bolt can be inserted through all the transverse bores and be secured by means of nuts on both sides of the cylinder tube. It is also possible, however, to provide the transverse bores of the cylinder tube with an internal thread, into which are screwed bolts which are provided with an external thread and which engage by means of a stud portion into the transverse bore of the closing plug and thus secure the latter.

Moreover, a threadless bolt can be inserted through the transverse bores and be secured therein by pinning, riveting or adhesive bonding. This is irrespective of whether the bolt is solid or hollow, that is to say designed as a holding tube.

However, the transverse bore of the closing plug can also be provided with an internal thread. This makes it possible to screw bolts which are shorter than the radius of the cylinder tube through the transverse bore of the cylinder tube into the transverse bore of the closing plug. It is possible, at the same time, to use both only two diametrically opposite bolts and a plurality of bolts distributed around the circumference of the cylinder tube.

When at least one channel connecting the transverse bore to the interior enclosed by the cylinder tube is provided in the closing plug, pressure medium can be introduced into and guided out of the cylinder tube via the transverse bores provided in the cylinder tube and in the closing plug. For this purpose, it is advantageous if the fastening means has a through-bore. This is connected to the channel. The fastening means thus forms at the same time a connecting flange for the compressed air preferably used as a pressure medium, so that the compressed-air connection is also prepared at the same time as the mounting of the closing plug on the cylinder tube.

In a simple way, the channel can be a bore lying coaxially relative to the cylinder tube. The bore can extend through a damping stud which is provided coaxially relative to the cylinder tube and to the closing plug and which can be received by a corresponding blind bore provided on the piston. The damping stud, in conjunction with the blind bore provided on the piston for the outflowing pressure medium, constitutes an increased flow resistance as soon as the stud projects into the blind bore. Consequently, the piston movement directed toward the closing plug is braked and a hard impact of the piston on the closing plug is prevented.

If the linear drive is actuated by a pressure medium, the interior enclosed by the cylinder tube is cylindrical, in order to allow a good sealing-off of the piston relative to the wall of the cylinder tube. In this case, the closing plug too is cylindrical. A seal is provided for sealing off the closing plug relative to the cylinder tube. The seal can, in a simple way, be an O-ring inserted into an annular groove provided in the closing plug. If this seal is arranged between the transverse bore and the end face of the closing plug facing the piston, there is no need for an additional sealing-off of the fastening means relative to the cylinder tube.

In another embodiment, the closing plug is provided with an axial through-bore lying coaxially relative to the cylinder tube. This is expedient particularly when the cylinder tube has no lateral slot for guiding out a web for force transmission. A piston rod can then be guided in a sealed-off manner through the through-bore. In this exemplary embodiment, the fastening means does not reach the middle of the closing plug. In that case, two bolts are screwed into the threaded transverse bore of the closing plug, and in the middle they leave the passage for the piston rod free. If at least one of the bolts is provided with a through-bore, in this embodiment too it can serve as a pressure-medium connection. The longitudinal bore leading through the closing plug is then sealed off relative to the piston rod on the outside, while, toward the cylinder interior, it forms with the piston rod an annular gap, through which the pressure medium can flow in and out relative to the bolt having the through-bore.

In a further embodiment, the piston is provided with two mutually parallel piston rods which are guided through corresponding parallel through-bores in the closing plug. The piston rods thus form an anti-rotation means for the piston. Moreover, once again, a continuous fastening means, such as, for example a holding tube, can be used.

An especially cost-effective production, particularly where larger quantities are concerned, is obtained if the closing plug is a plastic injection-molded piece. At the same time, the closing plug can be made in one piece with the damping stud, thus reducing the production outlay. It is also possible, however, to produce the closing plug as a part turned on an automatic lathe, for example from metal.

FIG. 1 shows a linear-drive cylinder 1 which serves as a linear module or linear drive and in which a cylinder tube 2 consisting of an extruded aluminum profile forms a basic body. The cylinder tube 2 encloses an interior 4 by means of a smooth wall 3 describing a cylinder. A piston 5 is mounted in the interior 4 so as to be axially displaceable and in a manner sealed off relative to the wall 3. The cylinder tube 2 is closed on the end faces by means of closing plugs 6, only one end of the cylinder tube 2 being shown in FIG. 1.

Figure 2:
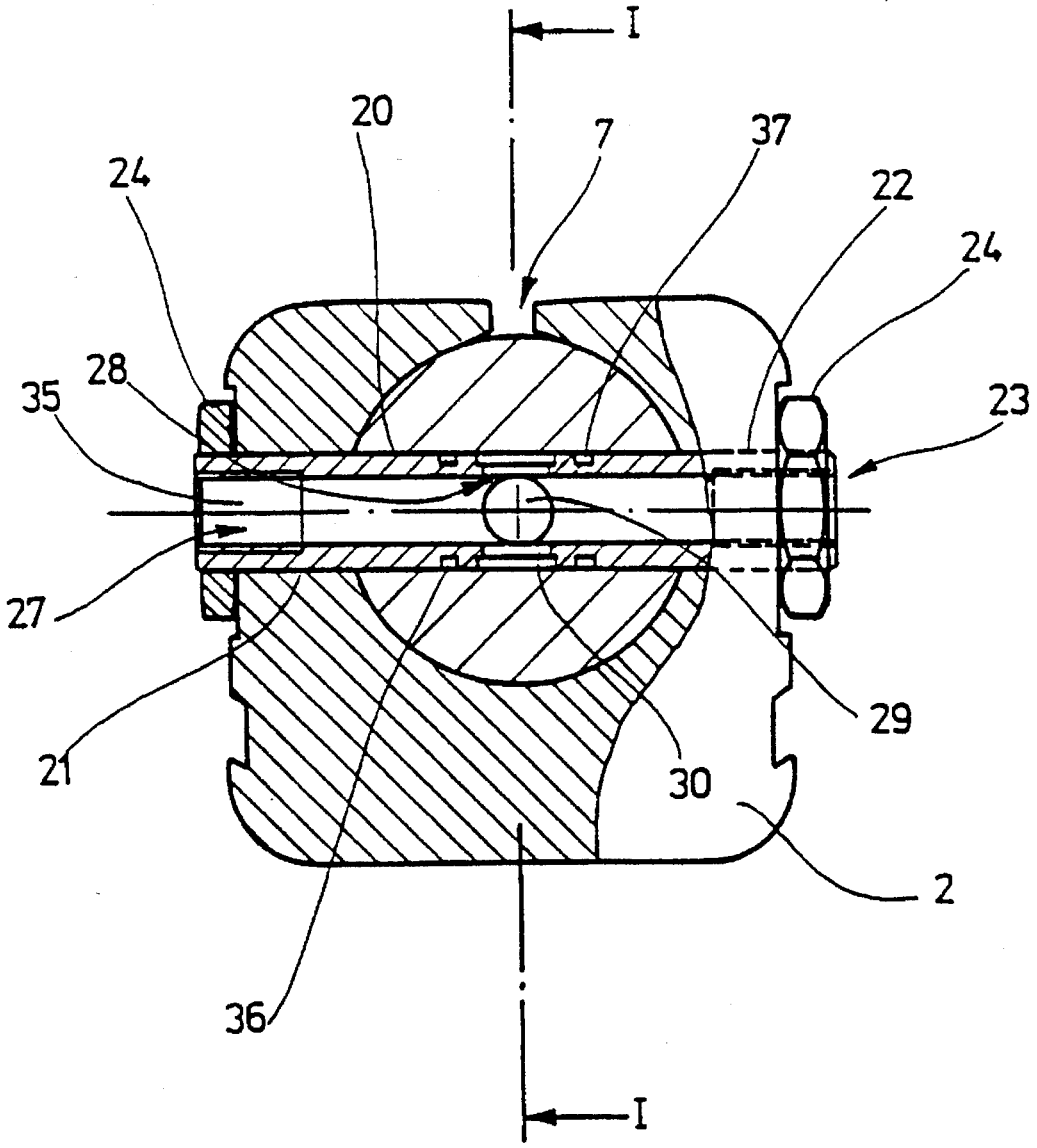
FIG. 2 shows the linear-drive cylinder according to FIG. 1 in a representation taken partially along the sectional line II—II, looking toward the end face.

As can be seen especially also from FIG. 2, the cylinder tube 2 is provided with a longitudinal slot 7, through which a web 8 fastened to the piston 5 and not shown further in detail passes.

The web 8 is connected to an essentially plate-shaped or cuboid driven part 9 which can execute a linear movement corresponding to the piston movement along the longitudinal extension 10 of the linear-drive cylinder 1.

The longitudinal slot 7 is sealingly closed by means of a sealing band 11 for overpressures prevailing in the interior 4, the sealing band 11 being guided inwards near the web 8 in a pressureless region of the linear-drive cylinder 1. The transmission of force from the piston 5 via the web 8 to the driven part 9 thus becomes possible. The sealing band 11 is held fixedly near the end face of the cylinder tube 2 by means of a screw connection merely indicated diagrammatically at 12.

The closing plug 6 is essentially cylindrical and is sealed off relative to the wall 3 of the cylinder tube 2 by means of an O-ring 16 lying in an annular groove 15. The closing plug 6 has two circular plane faces 17, 18 parallel to and at a distance from one another, the plane face 18 facing the interior 4 and the plane face 17 being flush with the end face of the cylinder tube 2.

Between the annular groove 15 and the plane face 17, the closing plug 6 is provided with a transverse bore 20 which, as emerges especially from FIG. 2, is aligned with two mutually opposite transverse bores 21, 22 of the cylinder tube 2. The transverse bores 20, 21, 22 have diameters coinciding with one another, and there passes through them a holding tube 23, the length of which is larger than the distance between the outsides of the cylinder tube of essentially rectangular cross-section. The holding tube 23 is provided on the end faces with external threads, onto which nuts 24 that form a locking device are screwed.

Figure 5:
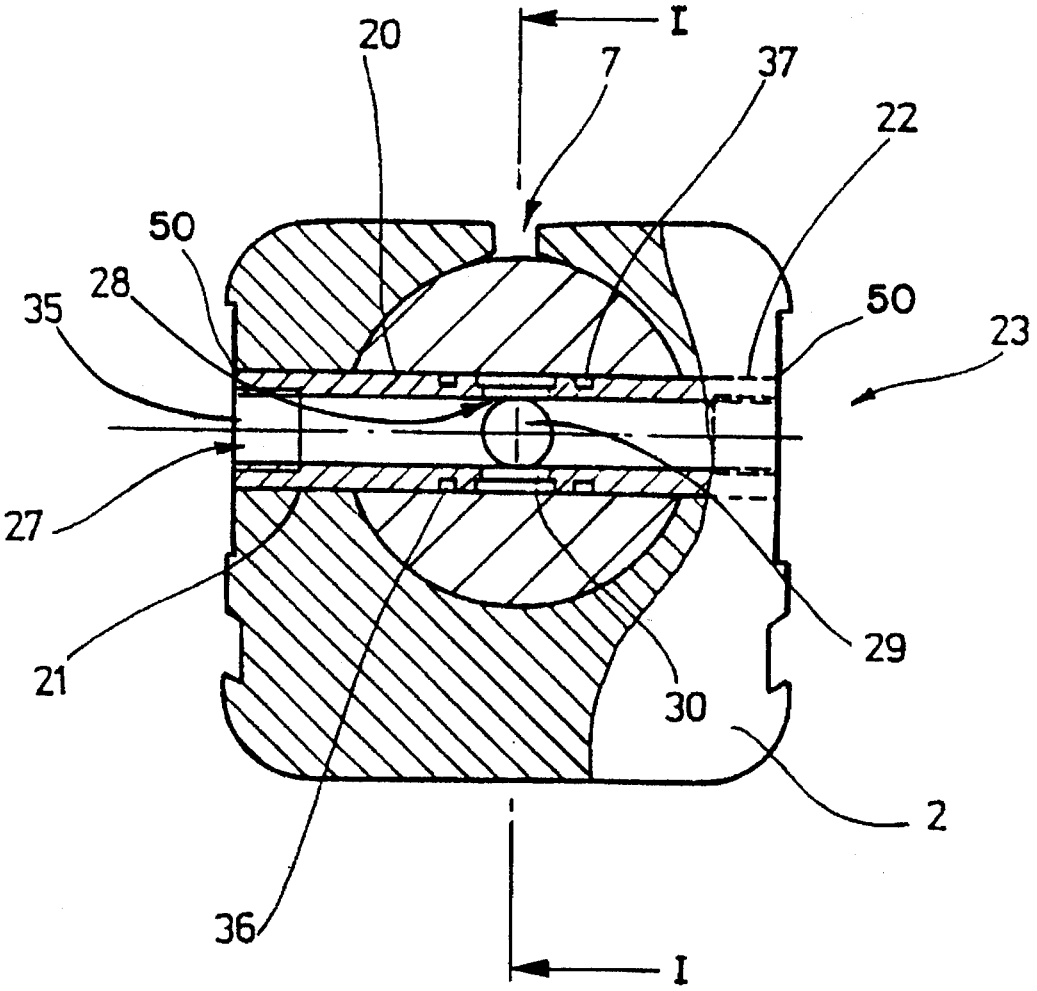
FIG. 5 is a view similar to FIG. 2 showing the fastening means pinned to the cylinder tube.
Figure 6:
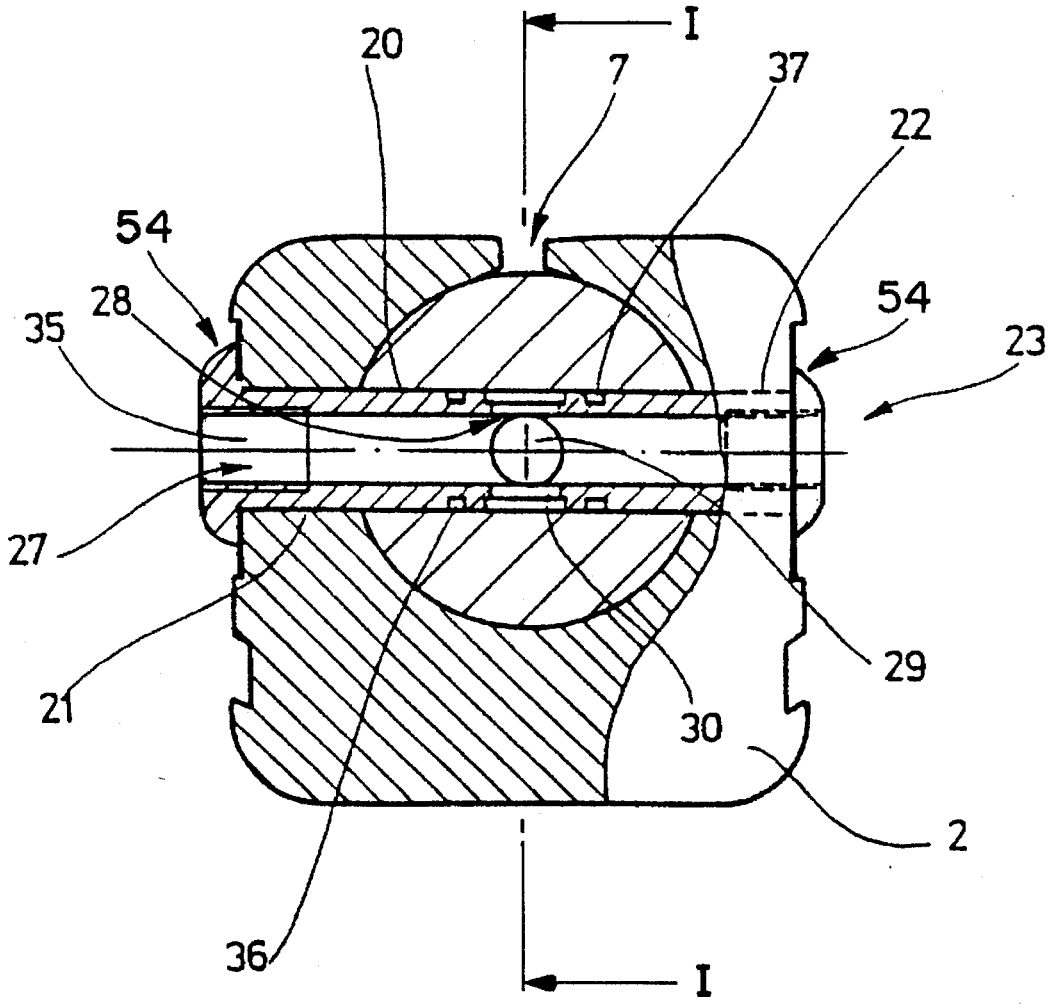
FIG. 6 is a view similar to FIG. 2 and showing the fastening means rivetted on its ends.
Figure 7:
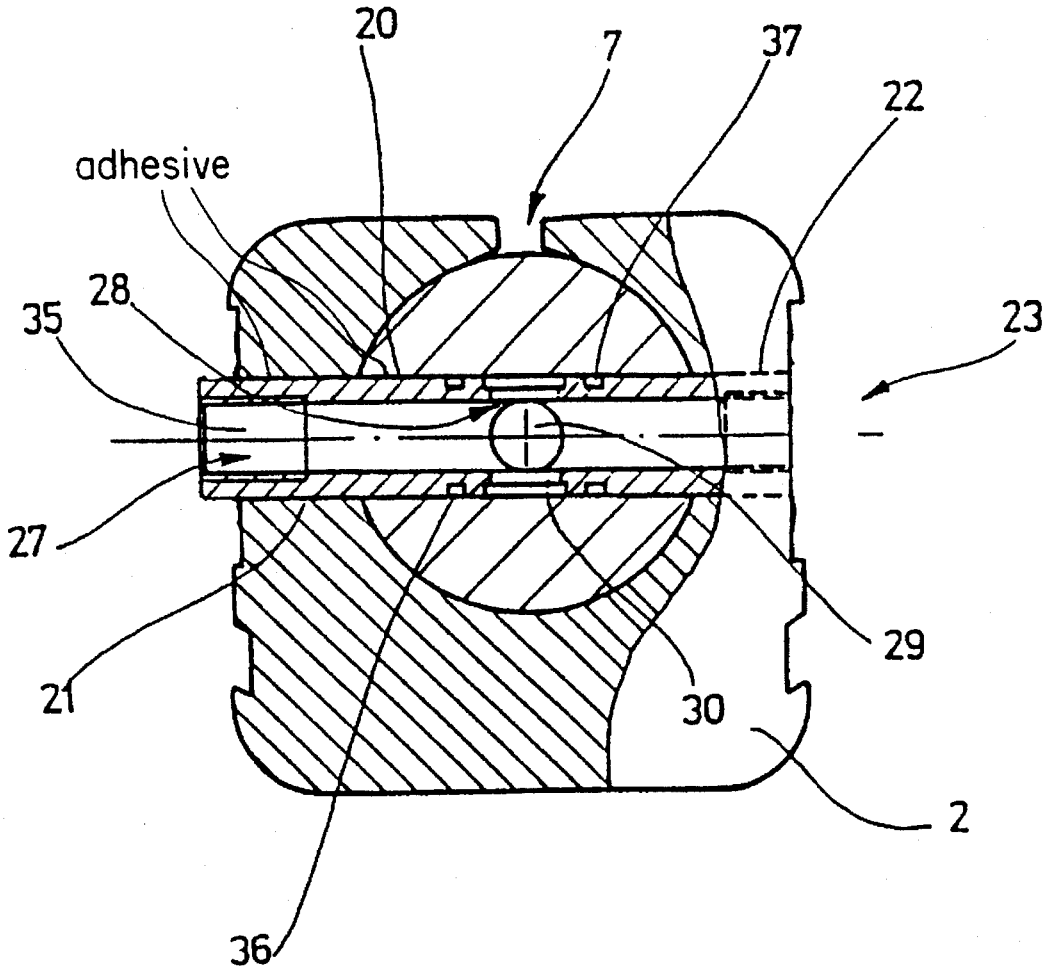
FIG. 7 is a view similar to FIG. 2 and showing the fastening means adhesively bonded to the cylinder tube.

As shown in FIGS. 5, 6 and 7, the holding tube 23 may be a threadless bolt which is inserted through the transverse bores 20, 21 and 22. As shown in FIG. 5, the holding tube 23 may be secured to the cylinder tube 2 with pins 50. FIG. 6 shows the holding tube 23 secured to the cylinder tube 2 by rivetting the holding tube 23 at its ends 54, 54. FIG. 7 shows the holding tube 23 secured to the cylinder tube 2 and closing plug 6 using an adhesive. The pins 50, the rivets, and the adhesive for the holding tube 23 form a locking device.

The holding tube 23 has a through-bore 27 and is additionally provided approximately centrally with altogether four outlet bores 28, 29, 30, 31.

The outlet bores 28, 29, 30, 31 open into a shallow groove 32 provided near them in the holding tube 23. The groove 32 communicates with an axial orifice, provided in the closing plug 6, or a channel 33 leading into the interior 4.

The channel 33 extends through a damping stud 34 formed on the closing plug 6.

The damping stud 34 is arranged coaxially relative to the closing plug 6 and to the cylinder tube 2 and extends in the direction of the piston 5.

The damping stud 34 is assigned a blind bore 35 which is provided in the piston 5 and of which the depth is larger than the length of the damping stud 34 and the inside diameter is larger than the outside diameter of the damping stud 34.

In order to make it possible for pressure medium to be fed into the interior 4 and discharged out of the latter via the holding tube 23, the holding tube 23 is provided near its through-bore 27 with an internal thread 35, into which an outer connection can be screwed. Moreover, to avoid pressure losses, annular grooves 36, 37, into which O-rings are inserted, are provided adjacent to the groove 32 of the holding tube 23.

Figure 4:
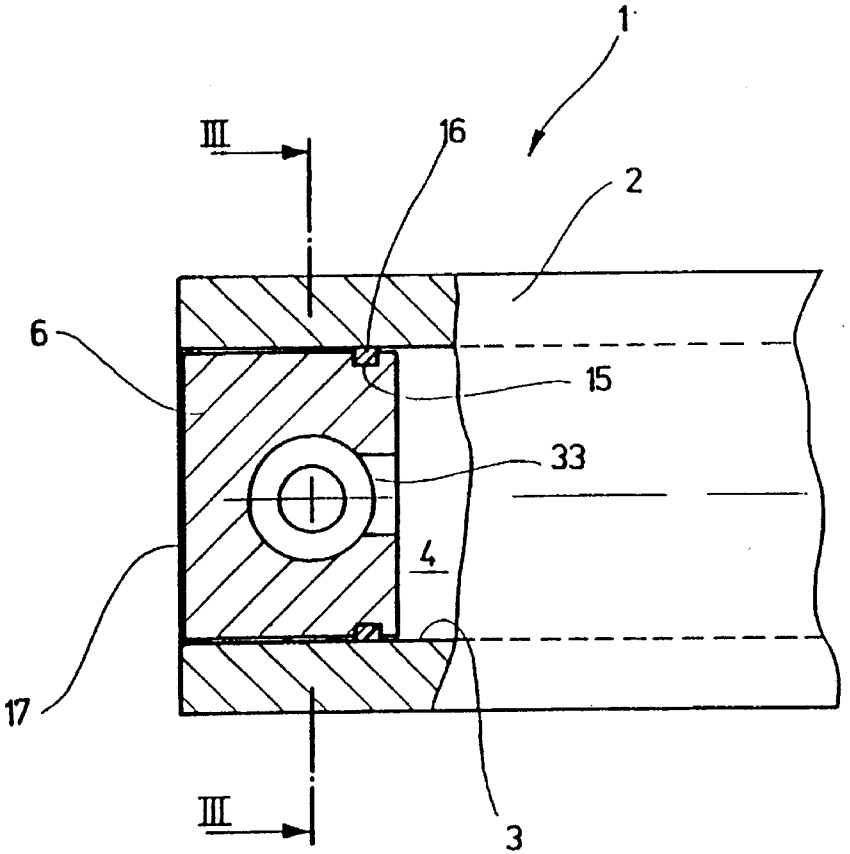
FIG. 4 shows the linear-drive cylinder according to FIG. 3 in a cut-out and partially cutaway side view.
Figure 3:
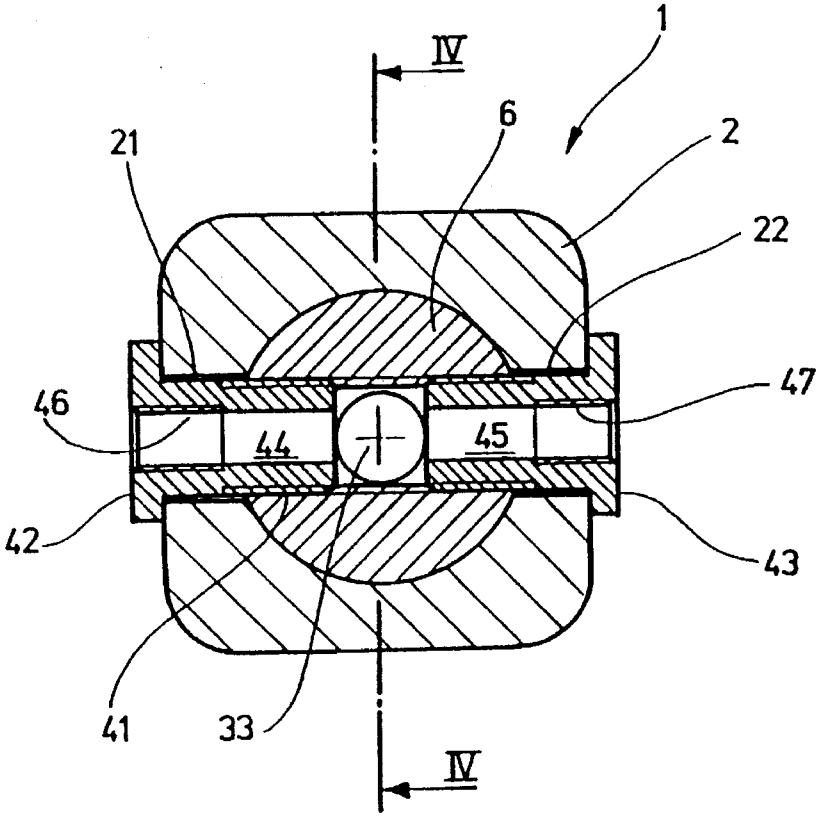
FIG. 3 shows another embodiment of the linear-drive cylinder in a sectional representation.

FIGS. 3 and 4 show another exemplary embodiment of the linear-drive cylinder 1, here too this being a pressure-medium cylinder with no piston rod and having a slotted cylinder tube 2. While FIG. 3 shows the linear-drive cylinder 1 in section along the sectional line III—III, FIG. 4 shows the end portion of the linear-drive cylinder 1 in section along the line IV—IV. A representation of the slot closed off by means of the sealing band 11 has been dispensed with in FIGS. 3 and 4.

As in the preceding exemplary embodiment, the cylinder tube 2 is closed on the end face by means of the closing plug 6 which is seated in the cylinder tube 2 in a manner sealed off on the wall 3 via the O-ring 16. In contrast to the preceding exemplary embodiment, the transverse bore of the closing plug 6 is provided with a continuous internal thread 41, into which are screwed both a screw 42 passing through the transverse bore 21 and, from the other side, a screw 43 passing through the transverse bore 22. The screws 42, 43 are tightened firmly and fix the closing plug 6 in the axial direction.

Both the screw 42 and the screw 43 are provided with respective through-bores 44, 45 which both communicate with the channel 33. In order to make it possible both to close the respective screws 42, 43 and to connect a pressure conduit, the two screws 42, 43 are provided near their through-bores 44, 45 with threads 46, 47. The screws 42, 43 thus serve both as fastening means for the closing plug 6 in the cylinder tube 2 and for feeding pressure medium into the interior 4.

It is possible, furthermore, to provide only one of the two screws 42, 43 with a through-bore which then serves as a connection for the pressure medium. Moreover, the closing plug 6 can be inserted into a non-slotted cylinder tube and serve as a closure on it.

Figure 8:
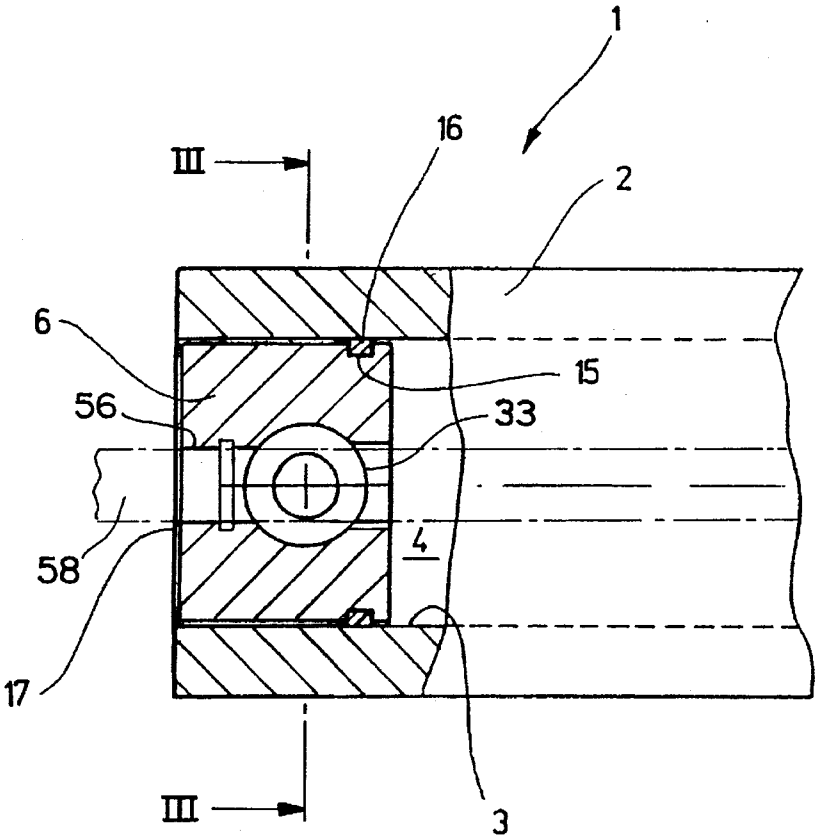
FIG. 8 is a view similar to FIG. 4 and showing an axial through-bore in the closing plug.

As shown in FIG. 8, if a continuous axial bore 56 is provided between the screws 42, 43 in the closing plug 6, the continuous axial bore 56 can receive a piston rod 58, in which case a corresponding seal is to be provided in the region between the transverse bore 20 and the plane end face 17.

Figure 9:
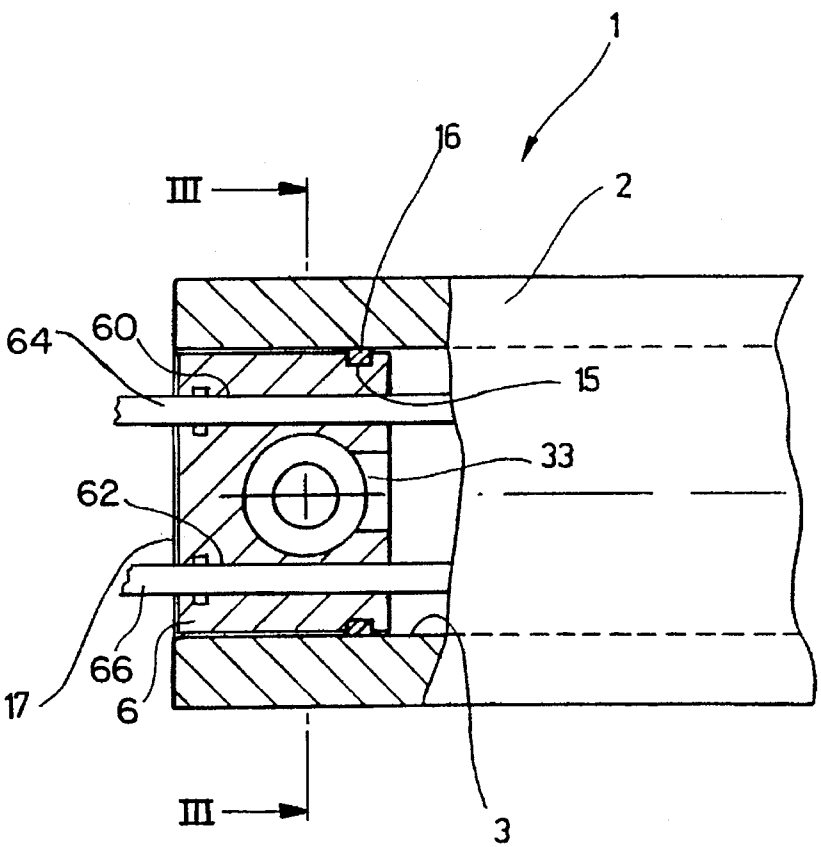
FIG. 9 is a view similar to FIG. 4 and showing two parallel piston rods.

In order to secure the piston 5 against rotations, FIG. 9 shows two mutually parallel piston rods 64, 66 which are both connected to the piston 5. The piston rods 64, 66 pass eccentrically through corresponding through-bores 60, 62 which are provided in the closing plug 6, in which bores 60, 62 they are guided in a sealed-off manner.

In this embodiment, the transverse bore 20 remains free, that is to say the through-bores for the piston rods do not intersect the transverse bore 20. A continuous holding tube 23 can thus be used as a fastening element.

Finally, the linear-drive cylinder 1 can also be actuated by a pull means. In this case, the screws 42, 43 are made without a through-bore and a sealing-off the closing plug 6 relative to the wall 3 of the cylinder tube 2 can be dispensed with. Instead, a winding device is seated on the closing plug 6 near the plane face 17 and actuates a pull means which is guided through an axial orifice provided in the closing plug 6 and which is fastened to the piston 5. The pull means can be a toothed belt, whilst the winding device is an electric motor connected to the toothed belt via gear means.

While the invention has been disclosed with reference to certain described embodiments, numerous changes, alterations and modifications to the described embodiments are possible without departing from the spirit and scope of the invention, as defined in the appended claims and equivalents thereof.

What is claimed is:

1. A linear-drive cylinder, comprising:

a cylinder tube having a longitudinal slot, a longitudinal direction and a bore transverse to the longitudinal direction, the bore having a longitudinal length;

a piston mounted in the cylinder tube and displaceable in the longitudinal direction;

a web connected to the piston that passes through the longitudinal slot;

a closure which closes an end of the cylinder tube and which projects with at least one portion into the cylinder tube; and fastening means for fastening the closure to the cylinder tube,the fastening means including at least one holding tube with a locking device;

wherein the closure includes a closing plug which is introduced into the cylinder tube, the closing plug including at least one transverse bore coaxial with the bore in the cylinder tube, the transverse bore being a through-bore with a longitudinal length extending entirely through the closing plug; and wherein the at least one holding tube extends transversely to the longitudinal direction of the cylinder tube into and for the entire longitudinal length of each of the transverse bore of the closing plug and the bore of the cylinder tube so that the locking device engages with the cylinder tube.

2. The linear-drive cylinder as claimed in claim 1, wherein the at least one holding tube and locking device provide a radial clamping force to the cylinder tube.

3. The linear-drive cylinder as claimed in claim 1, wherein the transverse bore of the closing plug is smooth-walled.

4. The linear-drive cylinder as claimed in claim 1, wherein the transverse bore of the closing plug includes an internal thread.

5. The linear-drive cylinder as claimed in claim 1, wherein the at least one holding tube includes a screw seated in the bore and the transverse bore.

6. The linear-drive cylinder as claimed in claim 1, wherein the at least one holding tube includes a bolt and the locking device includes a nut which secures the bolt.

7. The linear-drive cylinder as claimed in claim 1, wherein the at least one holding tube includes a bolt, and the bore of the cylinder tube includes an internal thread wherein the bolt is in engagement with the internal thread in the bore of the cylinder tube.

8. The linear-drive cylinder as claimed in claim 5, wherein the screw is shorter than an outer radius of the cylinder tube.

9. The linear-drive cylinder as claimed in claim 1, wherein the locking device comprises at least one pin.

10. The linear-drive cylinder as claimed in claim 1, wherein the locking device comprises at least one rivet connected to the at least one holding tube.

11. The linear-drive cylinder as claimed in claim 1, wherein the locking device comprises an adhesive that bonds the at least one holding tube together with the cylinder tube.

12. The linear-drive cylinder as claimed in claim 1, wherein the closing plug includes at least one channel connecting the transverse bore of the closing plug to an interior enclosed by the cylinder tube.

13. The linear-drive cylinder as claimed in claim 12, wherein the at least one holding tube includes a through-bore.

14. The linear-drive cylinder as claimed in claim 13, wherein the through-bore in the at least one holding tube is connected to the channel.

15. The linear-drive cylinder as claimed in claim 12, wherein the channel includes a second bore lying coaxially relative to the cylinder tube.

16. The linear-drive cylinder as claimed in claim 15, wherein the closing plug includes a damping stud lying coaxially relative to the cylinder tube and directed toward the piston.

17. The linear-drive cylinder as claimed in claim 16, wherein the second bore extends through the damping stud.

18. The linear-drive cylinder as claimed in claim 1, wherein the closing plug is essentially cylindrical.

19. The linear-drive cylinder as claimed in claim 1, further comprising a seal for sealing-off the closing plug relative to the cylinder tube.

20. The linear-drive cylinder as claimed in claim 19, wherein the closing plug includes an annular groove and the seal includes an O-ring inserted into the annular groove provided on the closing plug.

21. The linear-drive cylinder as claimed in claim 19, wherein the seal is arranged on the closing plug between the transverse bore and an end face of the closing plug, which faces the piston.

22. The linear-drive cylinder as claimed in claim 1, wherein the closing plug includes an axial through-bore lying coaxially relative to the cylinder tube.

23. The linear-drive cylinder as claimed in claim 22, further comprising a piston rod received in a sealed-off manner by the axial through-bore.

24. The linear-drive cylinder as claimed in claim 1, wherein the closing plug includes two mutually parallel axial through-bores.

25. The linear-drive cylinder as claimed in claim 24, further comprising two parallel piston rods connected to the piston and received in a sealed-off manner by the mutually parallel axial through-bores.

26. The linear-drive cylinder as claimed in claim 1, further comprising a flexible sealing band held fixedly on an end face of the cylinder tube wherein the longitudinal slot is sealed off by the flexible sealing band.

27. The linear-drive cylinder as claimed in claim 1, wherein the closing plug includes a plastic injection-molding.

28. The linear-drive cylinder as claimed in claim 16, wherein the closing plug is made in one piece with the damping stud.

29. The linear-drive cylinder as claimed in claim 1, further comprising a force-transmission means connected to the piston and guided out of the cylinder tube, and a driven member disposed outside the cylinder tube and connected to the force-transmission means.

* * * * *